US008147022B2

(12) United States Patent
Terada

(10) Patent No.: US 8,147,022 B2
(45) Date of Patent: Apr. 3, 2012

(54) RECORDING SYSTEM AND RECORDING METHOD

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 456 days.

(21) Appl. No.: 12/396,325

(22) Filed: Mar. 2, 2009

(65) Prior Publication Data

US 2009/0218762 A1 Sep. 3, 2009

(30) Foreign Application Priority Data

Feb. 29, 2008 (JP) ..... 2008-051417

(51) Int. Cl.
*B41J 29/38* (2006.01)
*B41J 29/393* (2006.01)
*B41J 2/01* (2006.01)

(52) U.S. Cl. ..... 347/16; 347/19; 347/101

(58) Field of Classification Search ..... 347/14, 347/16, 19, 101
See application file for complete search history.

(56) References Cited

U.S. PATENT DOCUMENTS 5,870,114 A 2/1999 Numata et al.
7,284,918 B2 10/2007 Nunokawa
7,681,974 B2 * 3/2010 Mizuno ..... 347/14
2007/0031175 A1 2/2007 Takeda et al.
2007/0176955 A1 * 8/2007 Yoshida ..... 347/16

FOREIGN PATENT DOCUMENTS

JP H05-221103 A 8/1993
JP H06-064258 A 3/1994
JP H08-164643 A 6/1996
JP H10-193706 A 7/1998
JP 2003-320718 A 11/2003
JP 2004-058526 A 2/2004
JP 2004-122638 A 4/2004
JP 2004-130602 A 4/2004
JP 2007-063016 A 3/2007

* cited by examiner

*Primary Examiner* — Jason Uhlenhake
(74) *Attorney, Agent, or Firm* — Baker Botts L.L.P.

(57) ABSTRACT

A recording system includes: a feeding device including a pair of rollers that cooperate with each other to nip a recording medium; a recording device which is configured to record an image on the recording medium; and a control device which is configured to control operations of the feeding device. The control device includes an adjusting portion which is configured to adjust an amount of head poke such that a trailing end of the recording medium is not stopped inside the predetermined range relative to a nip position of the pair of rollers.

13 Claims, 11 Drawing Sheets

RECORDING SYSTEM AND RECORDING METHOD

CROSS REFERENCE TO RELATED APPLICATION

The present application claims priority from Japanese Patent Application No. 2008-51417, which was filed on Feb. 29, 2008, the disclosure of which is herein incorporated by reference in its entirety.

BACKGROUND OF THE INVENTION

1. Field of the Invention

The present invention relates to a recording device and a recording method in which a recording medium is nipped by a pair of rollers of a feeding device and is intermittently fed in a feed direction and in which an image is recorded on the recording medium by a recording device while feeding of the recording medium by the feeding device is stopped.

2. Discussion of Related Art

There has been known an inkjet printer as a recording system that records an image on a recording sheet as a recording medium while the recording medium is intermittently fed. In the inkjet printer, a pair of rollers that are opposed to each other cooperate with each other to nip the recording sheet and feed onto a platen. When the recording sheet reaches the platen, the pair of rollers are intermittently rotated and driven by a predetermined feed amount. When the pair of rollers are temporarily stopped and the recording sheet is stopped on the platen, a recording head (a printhead) is reciprocated so as to eject droplets of ink toward the recording sheet. The droplets of ink which are selectively ejected from the recording head are landed on the recording sheet such that a desired image is formed on the recording sheet. The above-mentioned operation is repeatedly performed, and an image recording is sequentially performed from a portion of a leading end of the recording sheet to a portion of a trailing end thereof.

As described in JP-A-2004-122638 (hereinafter, referred to as "Patent Document 1"), there is known that, when the trailing end of the recording sheet passes through the pair of rollers, the recording sheet is pushed out (forward) or extruded in the feed direction. It is assumed that because a nipping pressure of the pair of rollers that are biased by a spring to a direction in which the pair of rollers move toward each other is released at one time, the trailing end of the recording sheet is pushed out in the feed direction. When the trailing end of the recording sheet is thus pushed out in the feed direction, the recording sheet is fed by a feed amount that is larger than a target feed amount. Accordingly, a positional relation between the recording head and the recording sheet is misaligned (located out of alignment), so that a banding occurs in a recorded image of the recording sheet. As mentioned in JP-A-2004-130602 (hereinafter, referred to as "Patent Document 2"), the banding occurs remarkably in a case where the recording sheet is stopped in a state in which the pair of rollers nip the trailing end of the recording sheet.

Patent Document 1 discloses that a printing (recording) operation is not performed when the trailing end of the recording sheet passes through the pair of rollers, and nozzles of the recording head that are used before and after the trailing end thereof passes through the pair of rollers are restricted, so that uneven (irregular) printing caused by a misalignment of the recording sheet relative to the recording head is prevented.

Patent Document 2 discloses that a nipping pressure of the pair of rollers varies between a case where the recording sheet is fed in a state in which a portion except the trailing end of the recording sheet is nipped by the pair of rollers and another case where the trailing end thereof passes through the pair of rollers, so that a jumping or a skipping is prevented from occurring when the trailing end thereof passes through the pair of rollers.

However, in order to realize respective means that are disclosed in Patent Document 1 and Patent Document 2, it is necessary to provide a structure for monitoring a position of the trailing end of the recording sheet, e.g., to provide a sensor in a feed path. Further, in Patent Document 1, because the nozzles of the recording head are restricted, a speed of image recording become slower before and after the trailing end of the recording sheet passes through the pair of rollers. In the recording system of Patent Document 2, there is needed to provide a mechanism for varying the nipping pressure of the pair of rollers, leading to such a problem that a recording system is complicated and large-sized. Therefore, a means for restraining the banding easily and at low cost is desired.

SUMMARY OF THE INVENTION

In the light of the above-described technical background, the present invention has been developed. It is therefore an object of the present invention to provide a recording system and a recording method in order to restrain occurring of the banding easily and at low cost.

According to the present invention, there is provided a recording system comprising: a feeding device which includes a pair of rollers that cooperate with each other to nip a recording medium having a first end and a second end and which is configured to intermittently feed the recording medium in a feed direction in such a manner that the first end is a leading end and the second end is a trailing end; a recording device which is provided on a downstream side of the feeding device in the feed direction and which is configured to record an image on the recording medium while feeding of the recording medium by the feeding device is stopped; and a control device which is configured to control operations of the feeding device. The control device includes an adjusting portion which is configured to adjust an amount of head poke that is an amount of the recording medium between the leading end thereof and a first position where the recording medium is nipped by the pair of rollers when a first recording operation is performed by the recording device, in a case where it is predicted that, when, assuming that an intermittent feeding of the recording medium and a recording operation thereon are repeated after the first recording operation, the recording medium is stopped, the trailing end is positioned within a predetermined range relative to a nip position of the pair of rollers, the adjusting portion being configured to adjust the amount of head poke such that the trailing end is not stopped inside the predetermined range (is stopped outside the predetermined range).

The recording system can be realized, for example, in the form of an inkjet printer. In the inkjet printer, the pair of rollers of the feeding device nip and intermittently feed the recording medium in the feed direction. While the recording medium is stopped, the recording device is moved in a direction perpendicular to the feed direction and records an image on the recording medium. In other words, because an intermittent feeding of the recording medium and an image recording operation thereon are alternately performed, the image is sequentially recorded from a side of the leading end of the recording medium to a side of the trailing end thereof.

When the image recording is performed, the pair of rollers of the feeding device feed the leading end portion of the recording medium to an image recording position by the recording device. In other words, the leading end portion of the recording medium is nipped by the pair of rollers and fed to the image recording position. The image recording is initiated in a state which the pair of rollers nip the it position of the recording medium. A dimension or length of the recording medium measured in the feed direction from the leading end to the first position is referred to as an amount of head poke. The amount of head poke (the head poke amount) is determined depending on a record-initiating position where the image recording is initiated on the portion of the leading end of the recording medium. For example, in a case where a margin is provided in the portion of the leading end, the record-initiating position is located on a upstream side of the leading end in the feed direction, and in a borderless printing, the record-initiating position is located on the leading end or on a downstream side of the leading end in the feed direction.

As mentioned before, because the intermittent feeding and the recording operation are alternately performed, the image is sequentially recorded from the leading end side of the recording medium to the trailing end side thereof. In the intermittent feeding for each line of image from the first position toward the trailing end, the feeding device sequentially nips each predetermined position of the recording medium and then is stopped. The control device adjust the head poke amount such that the trailing end is not positioned (stopped) within the predetermined range that is determined relative to the nip position of the pair of rollers. When the intermittent feeding is repeatedly performed after the recording medium is fed by the head poke amount that is such determined as mentioned previously, in a case where it is predicted that the trailing end is possible to be finally positioned within the predetermined range, the head poke amount is properly increased or decreased. Accordingly, it is prevented or at least restrained that the trailing end of the recording medium is nipped and stopped by the pair of rollers, so that it is prevented or at least restrained that the recording medium nipped by the feeding device is pushed out in the feed direction.

The predetermined range is desirably determined for the pair of rollers in order not to nip the trailing end and be stopped, regardless of an error of a whole length of the recording medium and an error of a feed amount of the feeding device. That the pair of rollers nip the trailing end and are stopped means that, in a case where the recording medium is a sheet of a certain thickness, either corner of the trailing end of the sheet in a thickness direction is put into contact with either of respective roller surfaces of the pair of rollers and is stopped.

According to the present invention, there is also provided a recording method in which a recording medium having a first end and a second end is nipped by a pair of rollers of a feeding device and is intermittently fed in a feed direction in such a manner that the first end is a leading end and the second end is a trailing end, and in which an image is recorded on the recording medium by a recording device that is provided on a downstream side of the feeding device in the feed direction while feeding of the recording medium by the feeding device is stopped, and in which an amount of head poke that is an amount of the recording medium between the leading end thereof and a first position where the recording medium is nipped by the pair of rollers when a first recording operation is performed by the recording device is adjusted, in a case where it is predicted that, when, assuming that an intermittent feeding of the recording medium and a recording operation thereon are repeated after the first recording operation, the recording medium is stopped, the trailing end of the recording medium is positioned within a predetermined range relative to a nip position of the pair of rollers, the amount of head poke being adjusted such that the trailing end is positioned outside the predetermined range.

In the recording system and the recording method to which the present invention is applied, the head poke amount H is adjusted such that the pair of rollers of the feeding device are not stopped in a state of nipping the trailing end of the recording medium, so that the feeding device is restrained from being stopped in the state of nipping the trailing end. Therefore, since the recording medium that is nipped by the feeding device is prevented or at least restrained from being pushed out in the feed direction, it is prevented or at least restricted that the banding occurs.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings. In the present embodiment, a multi-function device (MFD) 10 is described as an embodiment of a recording system to which the present invention is applied. However, the present invention is not limited to the present embodiment. It is to be understood that the present invention may be embodied with various changes and modifications that may occur to a person skilled in the art, without departing from the spirit and scope of the invention defined in the appended claims.

Figure 1:
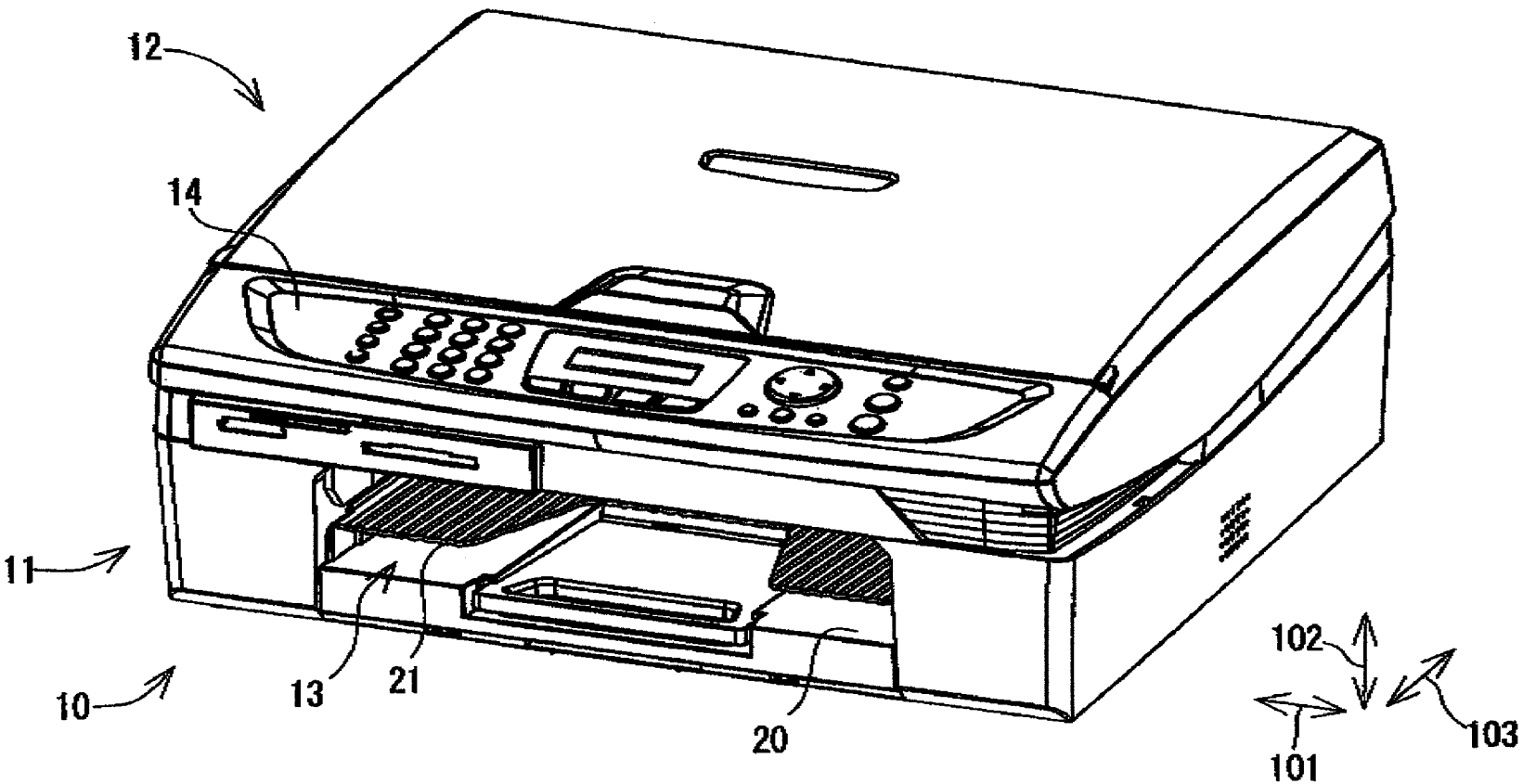
FIG. 1 is a perspective view of a multi-function device (MFD) in a first embodiment to which the present invention is applied.
Figure 2:
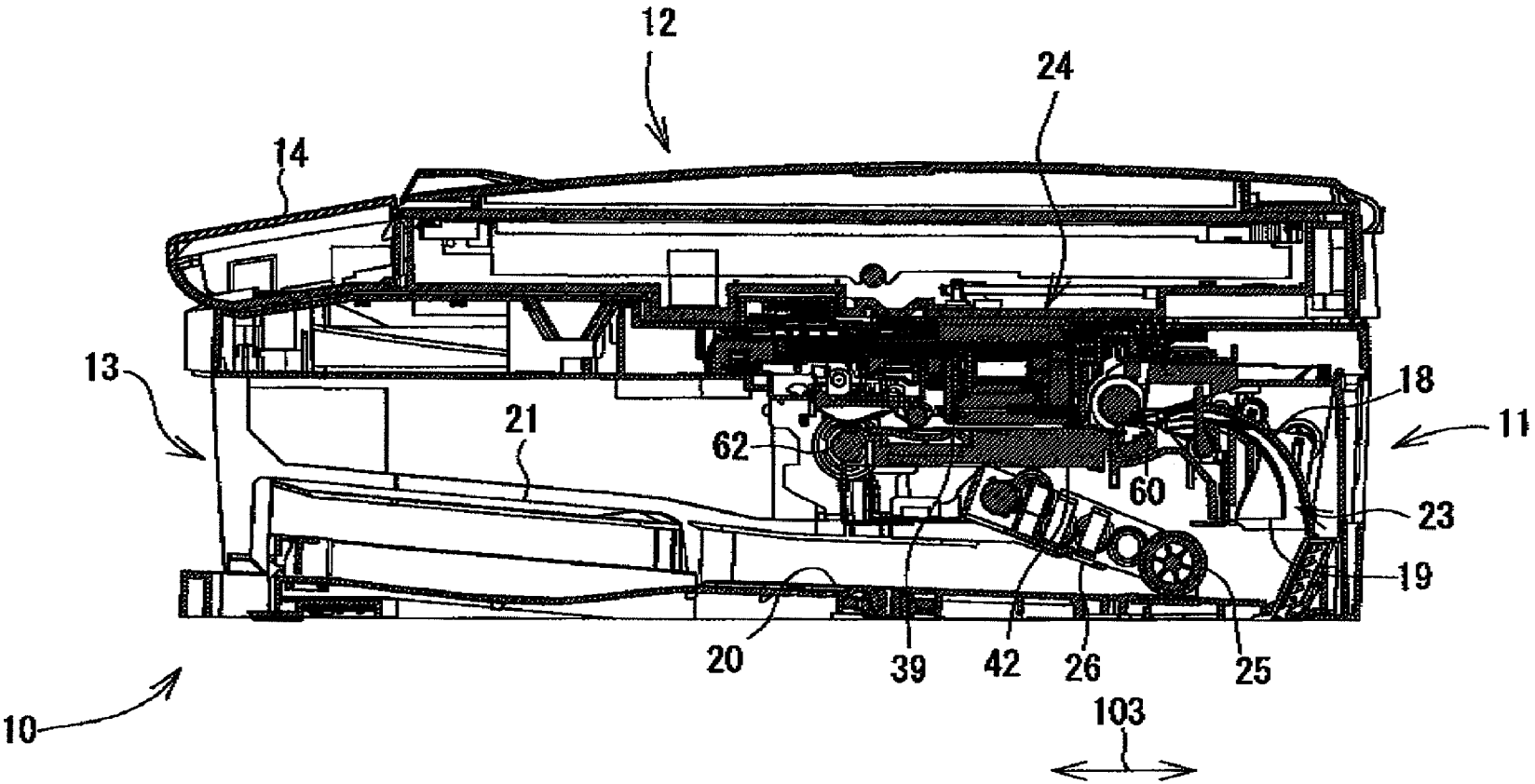
FIG. 2 is a side elevation view in cross section showing an internal structure of the MFD.

Hereinafter, there will be described a first embodiment of the recording system and a recording method to which the present invention is applied. As shown in FIGS. 1 and 2, the MFD 10 includes a printer portion 11 and a scanner portion 12 that are integral with each other, and has a printer function, a scanner function, a copier function and a facsimile-machine function. In the present embodiment, the printer portion 11 corresponds to a recording device to which the present invention is applied. The functions other than the printer function may be omitted, for example, the scanner portion 12 may be omitted. Thus, the present invention may be applied to a single-function printer that has only the printer function and does not have the scanner, copier or facsimile-machine function.

In the MFD 10, the printer portion 11 is provided in a lower portion thereof, and the scanner portion 12 is provided in an upper portion thereof. The MFD 10 is mainly connected to an external data-processor device such as a computer, so that the printer portion 11 can record, based on print data (record data) including image data and/or document data supplied from the computer, images (including characters) on a recording sheet as a recording medium. The scanner portion 12 is a so-called "flat-bed" scanner.

As shown in FIG. 1, a width (a dimension measured in a direction indicated by an arrow 101) and a length (a dimension measured in a direction indicated by an arrow 103) of the MFD 10 are greater than a height (a dimension measured in a direction indicated by an arrow 102) thereof. Thus, the MFD 10 has a generally rectangular parallelepiped shape. The printer portion 11 includes an opening 13 formed in a front surface of the MFD 10. Inside of the front surface in which the opening 13 is formed, a sheet-supply tray 20 and a sheet-discharge tray 21 are provided. A sheet-supply tray 20 and a sheet-discharge tray 21 are exposed through the front opening 13. The recording sheets accommodated by the sheet-supply tray 20 are supplied, one by one, to the printer portion 11, so that after a desired image is recorded on each recording sheet, the each sheet is discharged onto the sheet-discharge tray 21. In the following description of each of the components, a portion, an end, or a side of the each component which is located nearer to the front opening 13 will be referred to as a front portion, a front end, or a front side of the each component, and a portion, an end, or a side of the each component which is located opposite to the front opening 13 will be referred to as a rear portion, a rear end, or a rear side of the each component.

An operation panel 14 is provided in a front end portion of a top portion of the MFD 10. The operation panel 14 is for operating the printer portion 11 and the scanner portion 12. The operation panel 14 includes various operation keys that are used by a user or an operator to input various commands to operate the MFD 10 and a display that indicates a state of the MFD 10, an error indication and so on. In a case where the MFD 10 is connected to the above-described computer, the MFD 10 can be operated according to commands supplied from the computer via communication software such as a printer driver or a scanner driver.

As shown in FIG. 2, the sheet-supply tray 20 is disposed in a bottom portion of the MFD 10. The sheet-discharge tray 21 is disposed above the sheet-supply tray 20. In other words, the sheet-supply tray 20 and the sheet-discharge tray 21 have a vertically stacked structure. The sheet-supply tray 20 and the sheet-discharge tray 21 are connected to each other through a sheet-feed path 23 such that the recording sheets can be fed from the sheet-supply tray 20 to the sheet-discharge tray 21. The recording sheets accommodated by the sheet-supply tray 20 are fed to an image recording unit 24, guided by a U-turn portion of the sheet-feed path 28 through which the direction of feeding of each recording sheet is changed from a rearward direction to a frontward direction before the each recording sheet is fed to the image recording unit 24. After the image recording unit 24 records the image on the each recording sheet, the each sheet is discharged onto the sheet-discharge tray 21.

The sheet-supply tray 20 has a dish-like shape which includes a plurality of (four in the present embodiment) side walls standing upright from a periphery of a tray surface. The tray surface has an area in which the recording sheets are stacked on each other. The sheet-supply tray 20 can accommodate the plurality of recording sheets that are of a size, for example, not larger than A3 size (defined by JIS), A4 size, 15 size, and Postcard size.

The sheet-discharge tray 21 has a tray-like shape, and the each recording sheet on which an image is recorded is discharged onto an upper surface of the sheet-discharge tray 21. The sheet-discharge tray 21 is located on the front side of the sheet-supply tray 20 in a lengthwise direction of the MFD 10 (the direction indicated by the arrow 103). Therefore, the sheet-discharge tray 21 is not disposed above the sheet-supply tray 20 in the rear side of the MFD 10.

The sheet-supply roller 25 is provided in the rear side of the MFD 10. The sheet-supply roller 25 supplies each recording sheet stacked in the sheet-supply tray 20 to the sheet-feed path 23. A drive force or a rotation force of an LF (Line Feed) motor 77 (shown in FIG. 4) is transmitted to the sheet-supply roller 25 such that the sheet-supply roller 25 is rotated about a rotation axis. The sheet-supply roller 25 is rotatably supported by a lower or distal end portion of a sheet-supply arm 26. The sheet-supply arm 26 is pivotable about a rotation axis such that the distal end portion thereof where the sheet-supply roller 25 is supported functions as a distal end of a pivot, so that the sheet-supply roller 25 is movable upward and downward or movable away from and toward the sheet-supply tray 20. The sheet-supply arm 26 is pivoted downward because of a weight thereof, or a biasing force of a spring and is pivoted upward depending on an amount of the recording sheets stacked in the sheet-supply tray 20. Therefore, the sheet-supply roller 25 is in contact with an uppermost one of the recording sheets in the sheet-supply tray 20. When the sheet-supply roller 26 is rotated in this state, due to a friction force between a roller surface of the sheet-supply roller 25 and the uppermost recording sheet, the uppermost recording sheet is fed to the sheet-feed path 23.

The sheet-feed path 23 first extends upward from a rear portion of the MFD 10, and then curves toward the front side of the MFD 10. That is, the sheet-feed path 23 extends from the rear side of the MFD 10 toward the front side thereof via the image recording unit 24, and further extends to the sheet-discharge tray 21. Except for a portion of the sheet-feed path 23 where the image recording unit 24 is provided, the sheet-feed path 23 is defined and constituted by an outer guide surface and an inner guide surface that are opposed to each other with an appropriate distance therebetween. For example, at the U-turn portion of the sheet-feed path 23 in the rear side of the MFD 10, the sheet-feed path 23 is constituted by an outer guide member 18 and an inner guide member 19 which are fixed to each other inside a frame of the MFD 10.

Figure 3:
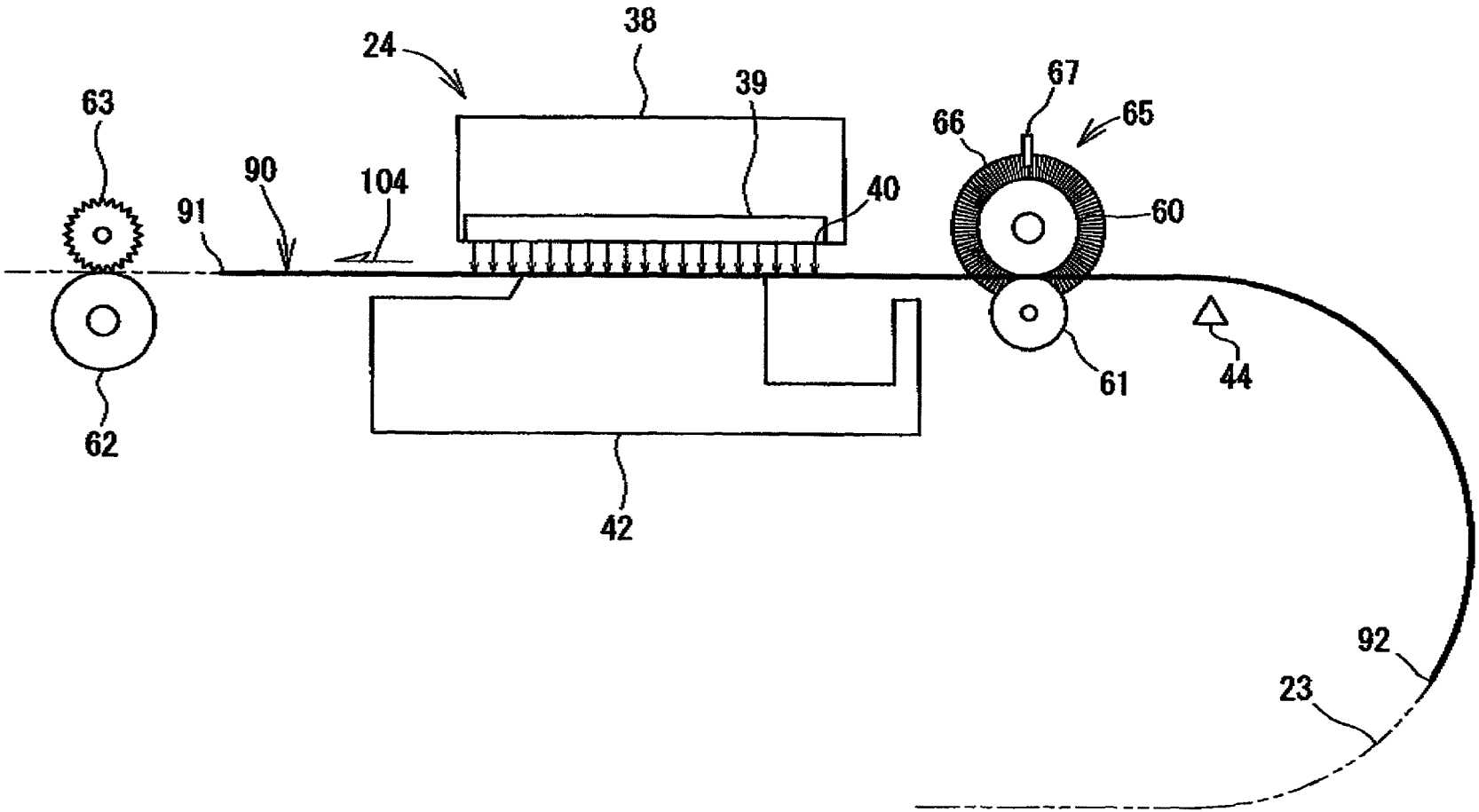
FIG. 3 is a schematic view of an image recording unit and around the image recording unit of the MFD.

As shown in FIGS. 2 and 3, the image recording unit 24 includes a recording head (a printhead) 39 and a carriage 38 that are opposed to each other and spaced from each other at a predetermined distance. A detailed construction of the image recording unit 24 will be described later.

A feed roller (a convey roller) 60 and a pinch roller 61 are provided on an upstream side of the image recording portion 24 in a feed direction 104 in which each recording sheet is fed from the tray 20. Although the pinch roller 61 is not shown in FIG. 2 behind other members, the pinch roller 61 is disposed below the feed roller 60, as shown in FIG. 3. The pinch roller 61 is movable toward and away from the feed roller 60 and is held in pressed contact with the feed roller 60 by a biasing force of an elastic member such as a spring. The feed roller 60 is driven or rotated by the LF motor 77.

As shown in FIG. 3, a rotary encoder 65 is provided in association with the feed roller 60. The rotary encoder 65 includes an encoder disc 66 which is disposed rotatably about the same rotation axis as the feed roller 60 and rotates with the feed roller 60, and an optical sensor 67 of transparent type. The encoder disc 66 includes transparent portions as sensible portions and shielding portions as non-sensible portions alternately arranged at a predetermined pitch in a circumferential direction thereof. Not precisely shown in FIG. 3, the optical sensor 67 has a light-emitting element which emits a light toward the encoder disc 66, and a light-receiving element which is opposed to the light-emitting element through the encoder disc 66 and receives a light emitted from the light-emitting element. When the encoder disc 66 rotates with the feed roller 60, a light emitted from the light-emitting element is intercepted by the shielding portions of the encoder disc 66 at the predetermined pitch. The light-receiving element produces electric pulse signals corresponding to strength of a received light. A rotation amount of the feed roller 60 is calculated based on the pulse signals.

The recording sheet 90 is fed in the feed direction 104 by a rotation of the feed roller 60 in a state in which the feed roller 60 and the pinch roller 61 (hereinafter, referred to as "the pair of rollers 60, 61") cooperate with each other to nip the recording sheet 90. At this time, the pinch roller 61 is rotated with feeding of the recording sheet 90. The pair of rollers 60, 61 correspond to a pair of rollers in the present invention. A feeding device in the present invention includes the pair of rollers 60, 61. Further, a leading end (edge) 91 and a trailing end (edge) 92 of the recording sheet 90 are a first end and a second end in the present invention, respectively.

A sheet discharge roller 62 and a spur roller 63 are provided on a downstream side of the image recording portion 24 in the feed direction. Though the spur roller 63 is not shown in FIG. 2 behind other members, as shown in FIG. 3, the spur roller 63 is disposed above the sheet discharge roller 62. The spur roller is movable toward and away from the sheet-discharge roller 62 and is held in pressed contact with the sheet-discharge roller 62 by a biasing force of an elastic member such as a spring. The sheet-discharge roller 62 is driven and rotated by the LF motor 77. The sheet-discharge roller 62 and the feed roller 60 are rotated in synchronism with each other. The sheet-discharge roller 62 and the spur roller 63 cooperate with each other to nip the recorded (printed) recording sheet 90 and to feed the same 90 onto the sheet-discharge tray 21.

When an image recording is performed, the feed roller 60 and the sheet-discharge roller 62 are intermittently driven or rotated. In other words, each of the feed roller 60 and the sheet-discharge roller 62 is successively rotated by a rotation amount corresponding to a target feed amount, and when each rotation amount reaches the target feed amount, a rotation of each of the feed roller 60 and the sheet-discharge roller 62 is stopped for a predetermined time. The target feed amount varies depending on a resolution of an image to be recorded on the recording sheet. For example, in a case where the image recording of interlace type is performed, the target feed amount in the image recording in a fine mode with a high resolution is generally determined to be smaller than the target feed amount in the image recording in a normal mode with a resolution of a middle extent.

When the image recording is not performed, it is not necessary that the feed roller 60 and the sheet-discharge roller 62 are intermittently driven. Therefore, when the recording sheet is fed before a performance of the image recording, and when the recording sheet is discharged after the performance of the image recording, the feed roller 60 and the sheet-discharge roller 62 may be successively rotated.

As shown in FIG. 3, on an upstream side of the feed roller 60 in the sheet-feed path 23 in the feed direction, a resistor sensor 44 is located. The resistor sensor 44 detects an existence of the recording sheet 90 passing through the sheet-feed path 23. Not shown in detail in FIG. 3, the resistor sensor 44 is a mechanical sensor in which an optical sensor detects a movement of a sensing element that is provided so as to rise and set in the sheet-feed path 23. The sensing element of the resistor sensor 44 protrudes to the sheet-feed path 23 in a state in which the recording sheet 90 is not in contact with the sensing element, and is retracted from the sheet-feed path 23 when the recording sheet 90 is put into contact with the sensing element. This protruding and retracting of the sensing element is detected by the optical sensor such that ON/OFF electric signals are generated. Thus, when the recording sheet 90 does not exist in a position where the resistor sensor 44 is provided, an OFF signal is outputted from the resistor sensor 44, while, when the recording sheet 90 exists therein, an ON signal is outputted from the resistor sensor 44. Based on a change or a shift of the thus outputted signals from the resistor sensor 44, it is determined whether a top end or the leading end 91 (located on a downstream portion of the recording sheet in the feed direction) or a bottom end or the trailing end 92 (located on an upstream portion of the recording sheet in the feed direction) of the recording sheet 90 reaches the position where the resistor sensor 44 is provided.

As shown in FIG. 3, the image recording unit 24 mainly consists of the carriage 38, the recording head 39 and a platen 42. The recording head 39 corresponds to a recording device in the present invention.

As shown in FIG. 3, between the pair of rollers 60, 61 as a pair, and the sheet-discharge roller 62 and the spur roller 63 as another pair, there are provided the carriage 38 above the sheet-feed path 28 and the platen 42 below the same 23. The carriage 38 carries the recording head 39 of an inkjet type. The carriage 38, driven by a carriage (COB) motor 79 (shown in FIG. 4), reciprocates in the main scanning direction, or in a horizontal direction perpendicular to the feed direction 104 (in a direction perpendicular to a sheet plane of FIG. 3) above the sheet-feed path 23. Not shown in FIG. 3, there are a plurality of (four in the present embodiment) ink cartridges disposed in the MFD 10, independently of the recording head 39. The four ink cartridges store a cyan ink (C), a magenta ink (M), a yellow ink (Y), and a black ink (10, respectively, and supply those inks to the recording head 39 via respective ink-supply tubes.

Below the sheet-feed path 23, the platen 42 is disposed so as to be opposed to the recording head 39. The platen 42 extends over an intermediate portion of a range of reciprocating movement of the carriage 38, i.e., a portion of the range where the recording sheets 90 pass. A width of the platen 42 as measured in a widthwise direction of the sheet-feed path 23 is larger than a maximum width of all sorts of the recording sheets that can be used in the printer portion 11. A constant (fixed) distance is maintained between the recording head 39 and the recording sheets 90 that are supported by an upper surface of the platen 42.

As mentioned previously, the carriage 38 reciprocates while the feed roller 60 and the sheet-discharge roller 62 are stopped. During a reciprocating movement of the carriage 38, the recording head 39 selectively ejects tiny droplets of inks of the respective colors through a plurality of nozzles thereof toward each recording sheet 90. The ink droplets ejected from the nozzles of the recording head 39 are landed on or received by each recording sheet 90 being temporarily stopped on the platen 42.

Hereinafter, a construction of a control portion (a controller) 70 of the MFD 10 will be described. The control portion 70 corresponds to a control device in the present invention. The control portion 70 is for controlling various operations of the MFD 10 including not only the printer portion 11 but also the scanner portion 12. Since the scanner portion 12 is not a major component to which the present invention is applied, detailed description thereof is omitted.

Figure 4:
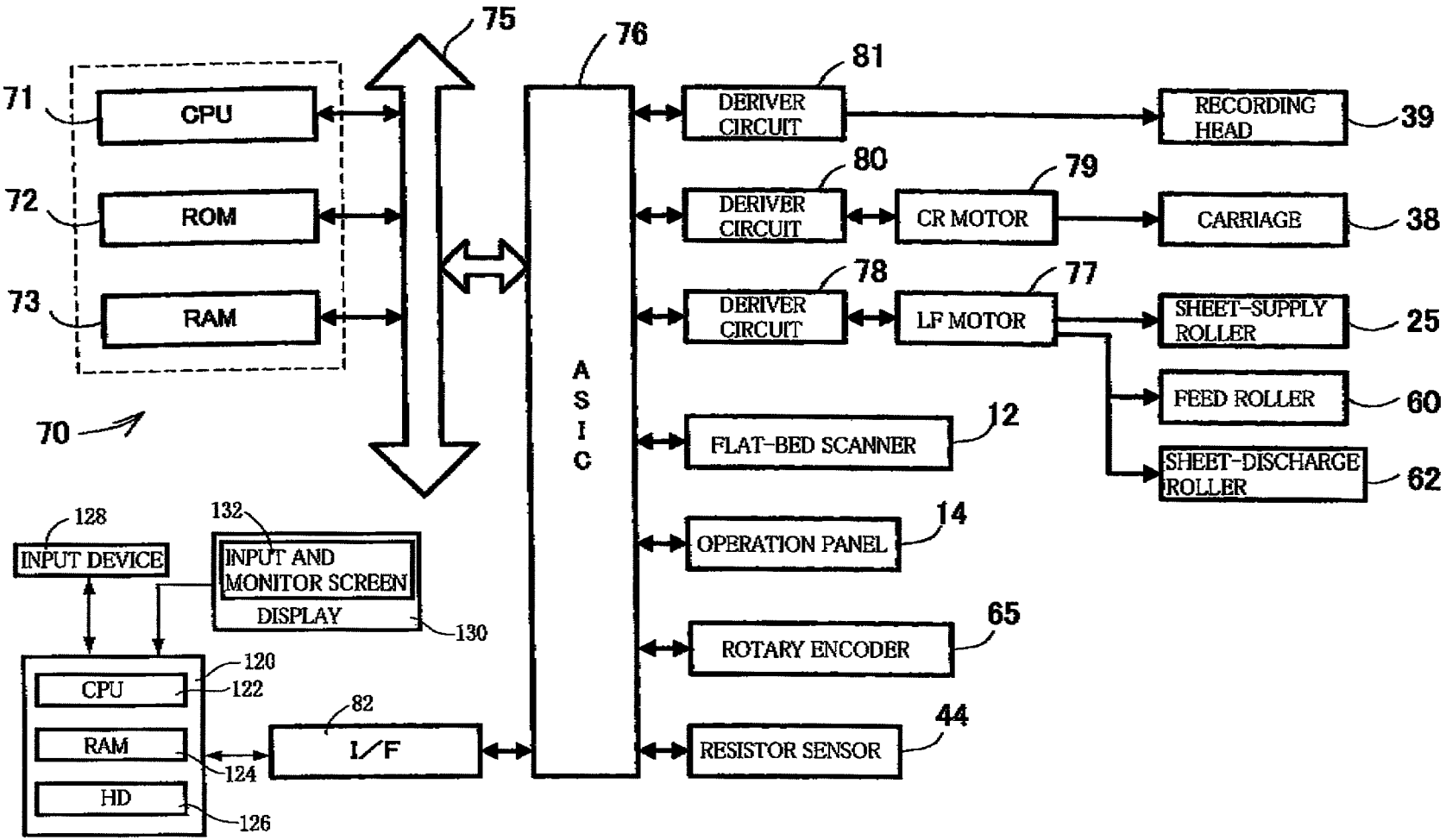
FIG. 4 is a block diagram showing a structure of a control portion of the MFD.

As shown in FIG. 4, the control portion 70 mainly includes a CPU (Central Processing Unit) 71, a ROM (Read Only Memory) 72 and a RAM (Random Access Memory) 73. The control portion 70 is connected to the sensors, the scanner portion 12, and the operation panel 14 and so forth such that data can be transmitted and received therebetween through a bus line 75 and an ASIC (Application Specific Integrated Circuit) 76. The RAM 73 functions as a size-data retaining portion, a resolution-data retaining portion and a margin-data retaining portion in the present invention. The operation panel 14 also functions as a size receiving portion, a resolution receiving portion and a margin receiving portion in the present invention.

In the ROM 72, various programs for controlling various operations of the MFD 10 are stored. One of the programs that are implemented by the control portion 70 is for correcting the head poke amount H in order for the trailing end 92 of the recording sheet 90 not to be nipped and stopped by the pair of rollers 60, 61 when the feed roller 60 is stopped. A correction of the head poke amount H is implemented by using of the following inequality (1), and a detail of a method of the correction of the head poke amount H will be described later.

$$\varepsilon_1 \leqq L - H - \sum_{K=1}^{N-1} F_{(K)} \leqq F_{(N)} - \varepsilon_2 \qquad \text{[Inequality (1)]}$$

($\varepsilon_1$, $\varepsilon_2$: constant)

The RAM 73 is used as a memory area or an operation area in which various data that are used when the CPU 71 implements the programs are temporarily stored.

The ASIC 76 generates a PWM (Pulse Width Modulation) signal fed to the LF motor 77 according to a command from the CPU 71 and feeds the PWM signal to a driver circuit 78. Because a PWM current corresponding to a drive signal is supplied from the driver circuit 78 to the LF motor 77, the control portion 70 controls a rotation of the LF motor 77.

The driver circuit 78 is arranged to drive the LF motor 77 that is connected to the sheet-supply roller 25, the feed roller 60 and the sheet-discharge roller 62. The driver circuit 78 generates a current signal for the rotation of the LF motor 77 when an output signal from the ASIC 76 is received. The LF motor 77 is rotated when the current signal is received, and a rotation force of the LF motor 77 is transmitted to the sheet-supply roller 25, the feed roller 60 and the sheet-discharge roller 62 via a well-known drive transmission device including a gear and a drive shaft.

The ASIC 76 generates a PWM signal fed to the CR motor 79 according to a command from the CPU 71 and feeds the PWM signal to a driver circuit 80 of the CR motor 79. Because a PWM current corresponding to a drive signal is supplied from the driver circuit 80 to the CR motor 79, the control portion 70 controls a rotation of the CR motor 79.

The driver circuit 80 is for driving the CR motor 79 that is connected to the carriage 38. The driver circuit 80 receives the output signal from the ASIC 76 and generates a current signal for a rotation of the CR motor 79. The CR motor 79 is rotated by receiving the current signal. The carriage 38 is reciprocated when a rotation force of the CR motor 79 is transmitted to the carriage 38 via a carriage drive device or a belt drive device.

The driver circuit 81 is for selectively ejecting the respective colors of inks from the recording head 39 toward the recording sheet 90 at a predetermined timing. The ASIC 76 generates an output signal based on a drive control signal outputted from the CPU 71. The driver circuit 81 receives the output signal from the ASIC 76 and drives and controls the recording head 39.

The resistor sensor 44 is connected to the ASIC 76. A sensing signal from the resistor sensor 44 is stored in the RAM 63 via the ASIC 76 and the bus line 75. Based on a program stored in the ROM 72, the CPU 71 analyzes the sensing signal and determines respective positions of the leading end 91 and the trailing end 92 of the recording sheet 90 in the sheet-feed path 23. The CPU 71 determines the respective positions of the leading end 91 and the trailing end 92 of the recording sheet 90 in the sheet-feed path 23, based on respective timings at which the leading end 91 and the trailing end 92 thereof are detected and respective feed amounts of the feed roller 60.

Further, the operation panel 14 is connected to the ASIC 76. An operation command of the printer portion 11, a size of the recording sheet 90, a resolution of a recorded image, margins provided in the recording sheet 90 that are inputted by the user or the operator from the operation panel 14 are stored in the RAM 73 as size data, resolution data and margin data thorough the ASIC 76 and the bus line 75.

Furthermore, the interface (I/F) 82 is connected to the ASIC 76. The control portion 70 can transmit data to the external data-processor device and receive data from the external data-processor device through the interface 82. The external data-processor device is, for example, the computer 120 shown in FIG. 4, which mainly includes a CPU 122, a RAM 124 and a HD (hard disk) 126, and which is connected to the MFD 10 via the I/F 82. An input device 128 and a display 130 are connected to the computer 120. The display 130 displays (shows) an input and monitor screen 132, and various data (information) can be inputted through the screen 132 and the input device 128. Further, in the HD 126 of the computer 120, the printer driver is installed. The external data-processor device functions as the size receiving portion, the resolution receiving portion and the margin receiving portion in the present invention. The size of the recording sheet 90, and the resolution and the margin that are inputted when the printer portion 11 is operated may be inputted from the operation panel 14 or from the printer driver of the external data-processor device. In the former case (an input from the operation panel 14), the RAM 73 functions as the size-data retaining portion, the resolution-data retaining portion and the margin-data retaining portion in the present invention. In the latter case (an input from the printer driver), the RAM 124 of the external data-processor device functions as the size-data retaining portion, the resolution-data retaining portion and the margin-data retaining portion in the present invention.

Hereinafter, the method of correcting the head poke amount H in the printer portion 11 will be described by reference to a flow chart of FIG. 5. In the present embodiment, the computer 120 as the external data-processor device is connected to the MFD 10, and the size of the recording sheet 90, the resolution of the recorded image and the margin on the recording sheet 90 are inputted from the printer driver that is installed in the computer 120. Therefore, a keyboard and a mouse of the computer 120 function as a size receiving portion, a resolution receiving portion and the margin receiving portion, and the RAM 124 thereof functions as the size-data retaining portion, the resolution retaining portion and the margin-data retaining portion.

In a case where the size of the recording sheet 90, the resolution of the recorded image and the margin on the recording sheet 90 are inputted from the operation panel 14 of the MFD 10, not described in the present embodiment, the operation panel 14 functions as the size receiving portion, the resolution receiving portion and the margin receiving portion in the present invention, and the RAM 73 of the control portion 70 functions as the size-data retaining portion, the resolution-data retaining portion and the margin-data retaining portion in the present invention.

Prior to an input of the command to initiate a printing operation to the printer driver, the size of the recording sheet 90, the resolution of the recorded image, and the margins provided in the recording sheet 90 are inputted by the operator through the input screen 132 that is displayed in the computer 120. The computer 120 operates to store the size of the recording sheet 90, the resolution of the recorded image and the margins provided in the recording sheet 90, respectively as the size data, the resolution data and the margin data in the RAM 124. In a description later, information including the size data, the resolution data and the margin data will be sometimes referred to as driver configuration (setting) information or data.

The size of the recording sheet 90 includes, e.g., A4 size and B5 size, defined by JIS (Japanese Industrial Standards). The resolution of the recorded image on the recording sheet 90 is expressed by a number of dots per a unit of dimension of the recording sheet 90, and includes, e.g., 600 dpi, 1200 dpi and 2400 dpi. The margin corresponds to an area that is formed between at lest one of two ends and two sides of the recording sheet 90 and at least corresponding one of two ends and two sides of an actual recording area. The margins can be provided on leading and trailing end portions, and on opposite side portions of the recording sheet 90. In the present embodiment, the margin on the leading end portion is referred to as a margin U. The margin U corresponds to a margin in the present invention. The margin U is indicated at a unit of millimeter. In a case where a borderless printing is selected, the margin U is determined as zero or a negative value.

Figure 5:
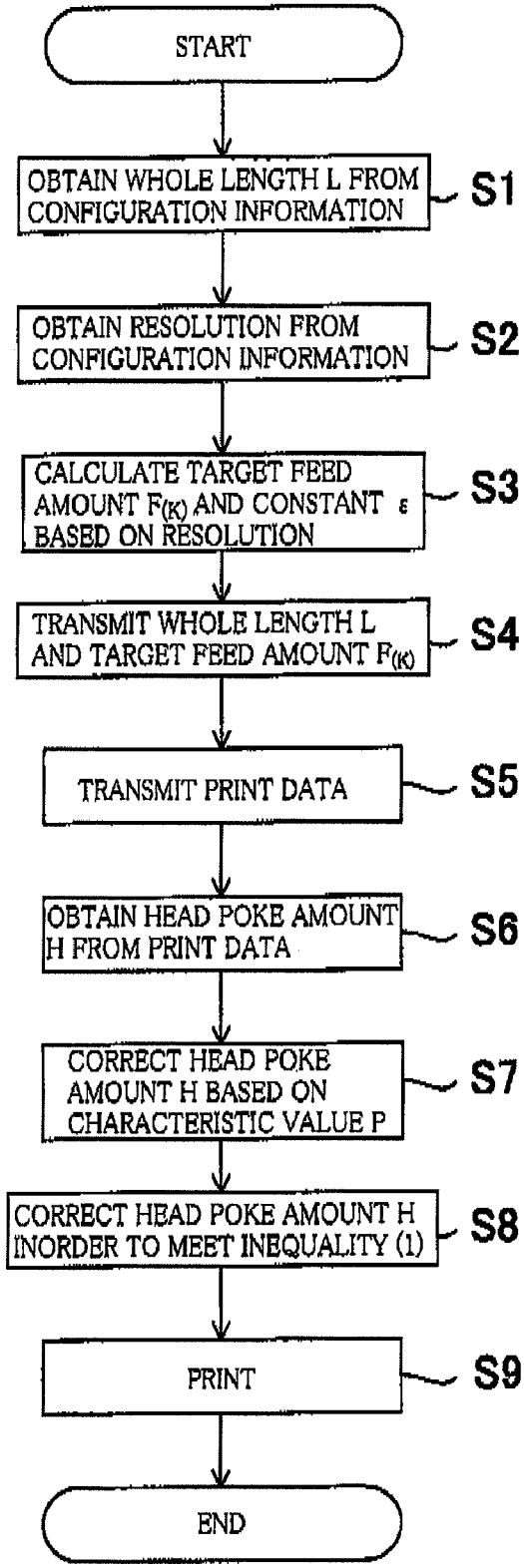
FIG. 5 is a flow chart illustrating a recording method in the first embodiment.

When the command to initiate the printing operation is inputted, in step S1 in FIG. 5, the control portion 70 receives a whole length L of the recording sheet 90 from the driver configuration information. In the RAM 124 of the computer 120, the size data such as A4 size are stored, so that the whole length L is obtained based on the size data stored in the RAM 124. For example, in a case where the size is A4 size, the whole length L is 297 mm.

Next, in step S2, the printer driver receives the resolution from the driver configuration information, and in step S3, a target feed amount $F_{(K)}$ and a constant $\epsilon$ are calculated based on the obtained resolution. Because a plurality of nozzles, are disposed in the recording head 39 at a predetermined pitch in the feed direction 104, each recording head 39 has a characteristic resolution depending on the pitch of the nozzles. In order to achieve the resolution from the driver configuration information corresponding to the characteristic resolution, the target feed amount $F_{(K)}$ is determined. The target feed amount $F_{(K)}$ is stored in the RAM 124 of the computer 120 in the form of a look-up table in which a plurality of target feed amounts $F_{(K)}$ are predetermined depending on a plurality of resolutions that can be inputted. In the target feed amount $F_{(K)}$, "K" indicates a number of times that the recording sheet 90 is intermittently fed. Although the respective target feed amounts $F_{(K)}$ are constant in the present embodiment, the respective target feed amounts $F_{(K)}$ are not necessarily constant in the present invention.

The constant $\epsilon$ is also obtained corresponding to the target feed amount $F_{(K)}$. The constant $\epsilon$ is a constant for indicating that it is prohibited that, when the intermittent feeding is stopped, a distance between the nip position of the pair of rollers 60, 61 and the trailing end 92 of the recording sheet 90 is smaller than the constant $\epsilon$. For example, in a case where it is prohibited that, when the intermittent feeding of the recording sheet 90 is stopped, the distance between the nip position of the pair of rollers 60, 61 and the trailing end 92 of the recording sheet 90 is smaller than 0.5 mm, the constant $\epsilon$ is changed to 0.5 mm. A plurality of constants $\epsilon$ are predetermined depending on the respective target feed amount $F_{(K)}$ and are stored in the form of a look-up table in the RAM 124 of the computer 120. These constants $\epsilon$ are determined at will within a range that meets such a condition as $0<\epsilon<F_{(N)}$.

The whole length L of the recording sheet 90, the target feed amount $F_{(K)}$ and the constant $\epsilon$ that are obtained as mentioned above are transmitted from the printer driver to the control portion 70 of the MFD 10 (step S4). The printer driver also transmits image data that are obtained from application soft installed in the computer 120 as print data to the control portion 70 (step S5). The print data includes a head poke amount $H_0$ based on the margin data.

The control portion 70 receives and stores in the RAM 73 the whole length L of the recording sheet 90, the target feed amount $F_{(K)}$, the constant the constant $\epsilon$ and the print data. Then, in step S6, the control portion 70 obtains the head poke amount H that is included in the print data stored in the RAM 73. Next, in step S7, the control portion 70 corrects the obtained head poke amount $H_0$ based on a characteristic value. P of the MFD 10. The characteristic value P is previously stored in the ROM 72.

Figure 6:
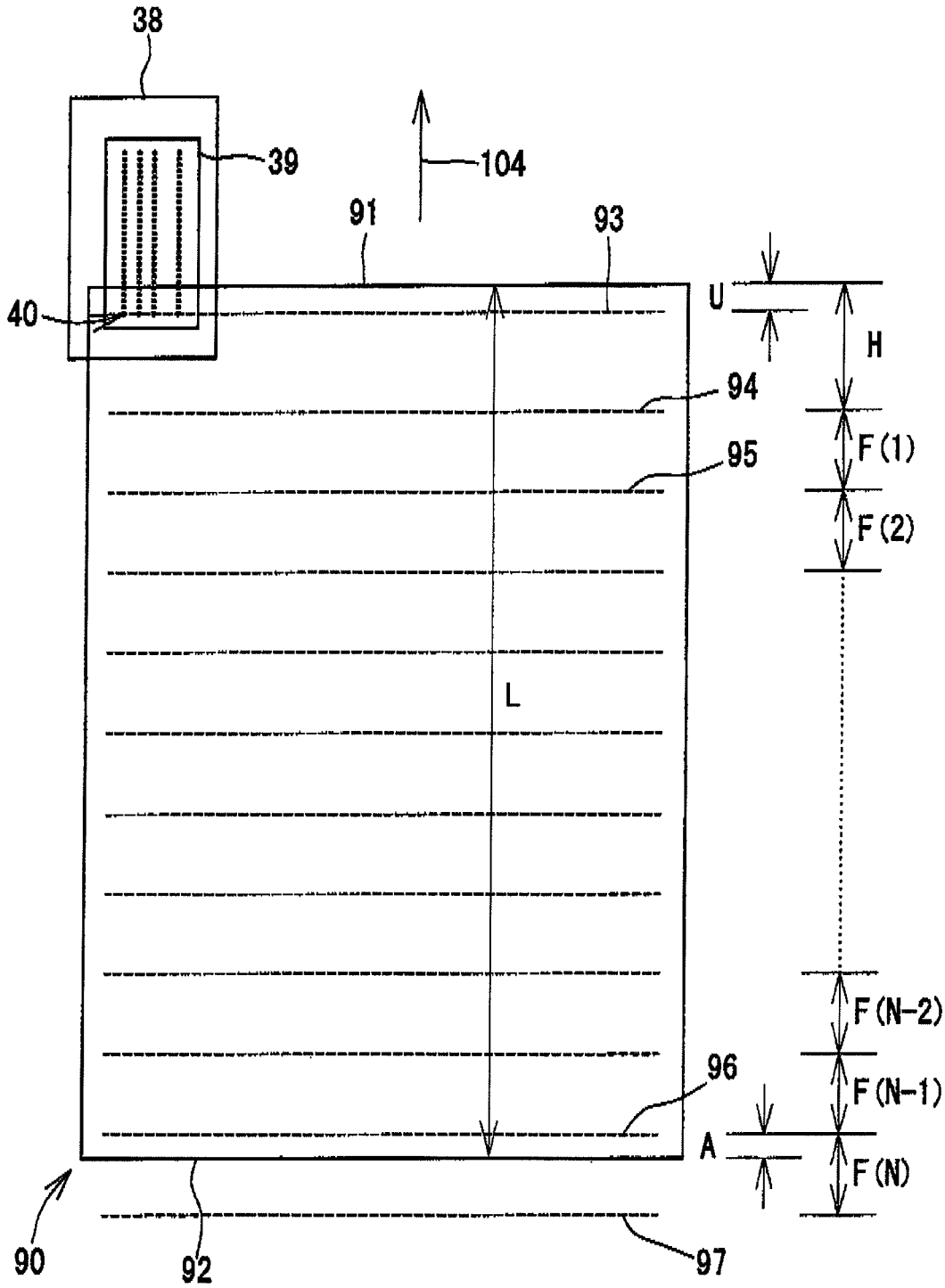
FIG. 6 is a schematic view showing relations among a margin, target feed amounts, a remainder and so on of a recording sheet.
Figure 7:
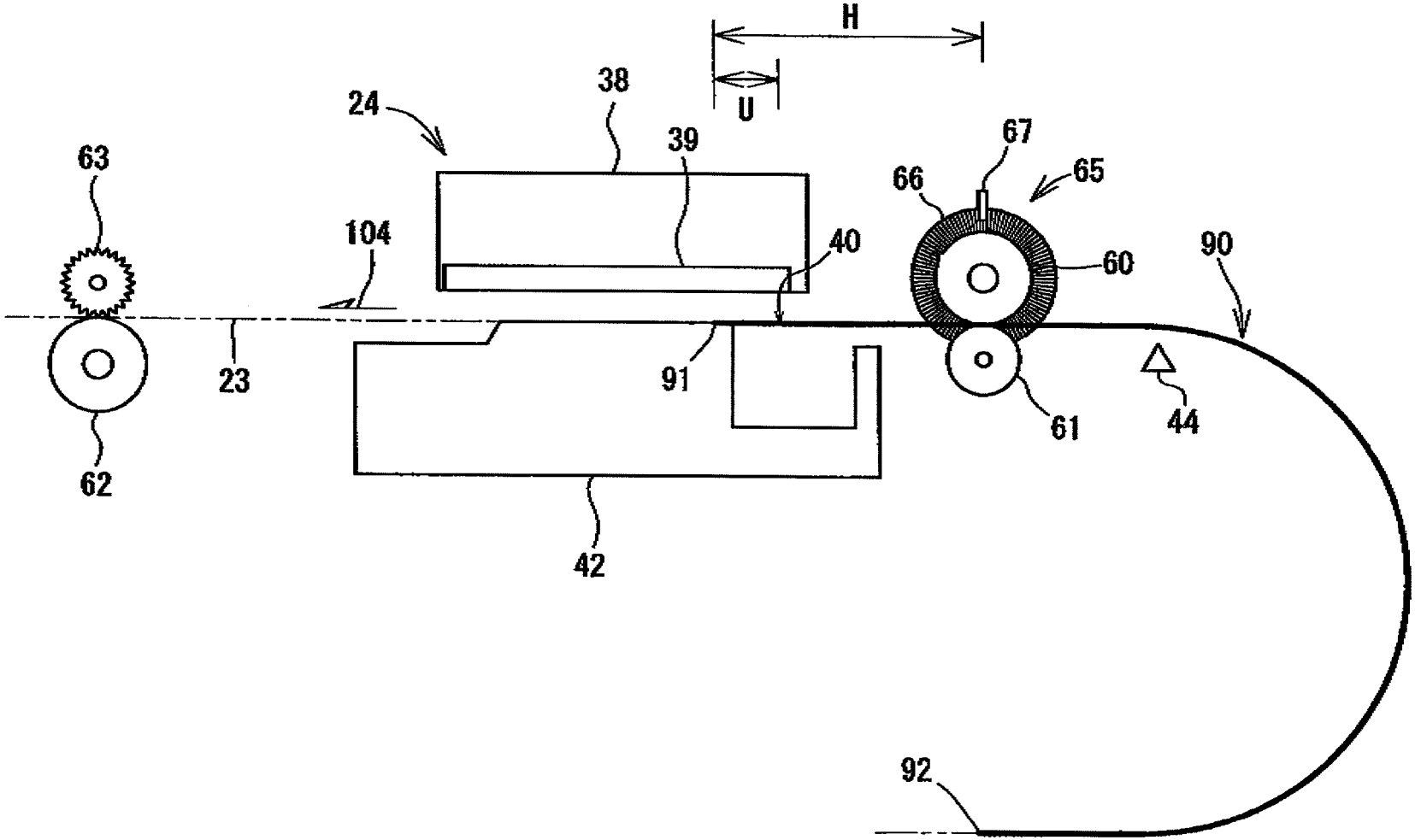
FIG. 7 is a schematic view of a state of the recording sheet after a head poke is performed in the printer portion.

As shown in FIGS. 6 and 7, the head poke amount $H_0$ is a target amount for feeding the leading end 91 of the recording sheet 90 to the downstream side in the feed direction 104 from the nip position where the pair of rollers 60, 61 nip the recording sheet 90, when the image recording on the leading end portion of the recording sheet 90 is initiated. In the recording sheet 90 that is fed by the head poke amount $H_0$, a record-initiating position 93, i.e., a position spaced from the leading end 91 of the recording sheet 90 to the trailing end 92 thereof by the margin U, corresponds to or is opposed to a first nozzle 40 or a first one of the nozzles of the recording head 39 that is located on a most upstream side in the feed direction 104, and a first nip position 94 of the recording sheet 90 is nipped by the pair of rollers 60, 61 in order that the recording sheet 90 is stopped. The above-mentioned state is a state of completion of head poke, and, in the present embodiment, a first recording operation is initiated at a position where the recording sheet 90 is fed by the target feed amount $F_{(1)}$ further from the state of completion of the head poke. However, it is not necessary that the recording sheet 90 is stopped in the state of completion of head poke. The recording sheet 90 may be first stopped after being fed by an amount equal to a total of the head poke amount $H_0$ and the target feed amount $F_{(1)}$, and the first recording operation may be performed in this state.

As shown in FIG. 7, a distance, that corresponds to the "H" in FIG. 7, between the nip position where the pair of rollers 60, 61 nip the recording sheet 90 and the first nozzle 40 of the recording head 39 varies slightly depending on dimension errors and so on of each of a plurality of MFDs 10. Therefore, variations of the distance corresponding to the head poke amount $H_0$ are corrected based on the characteristic value P. The corrected head poke amount is referred to as a head poke amount $H_1$.

Figure 8:
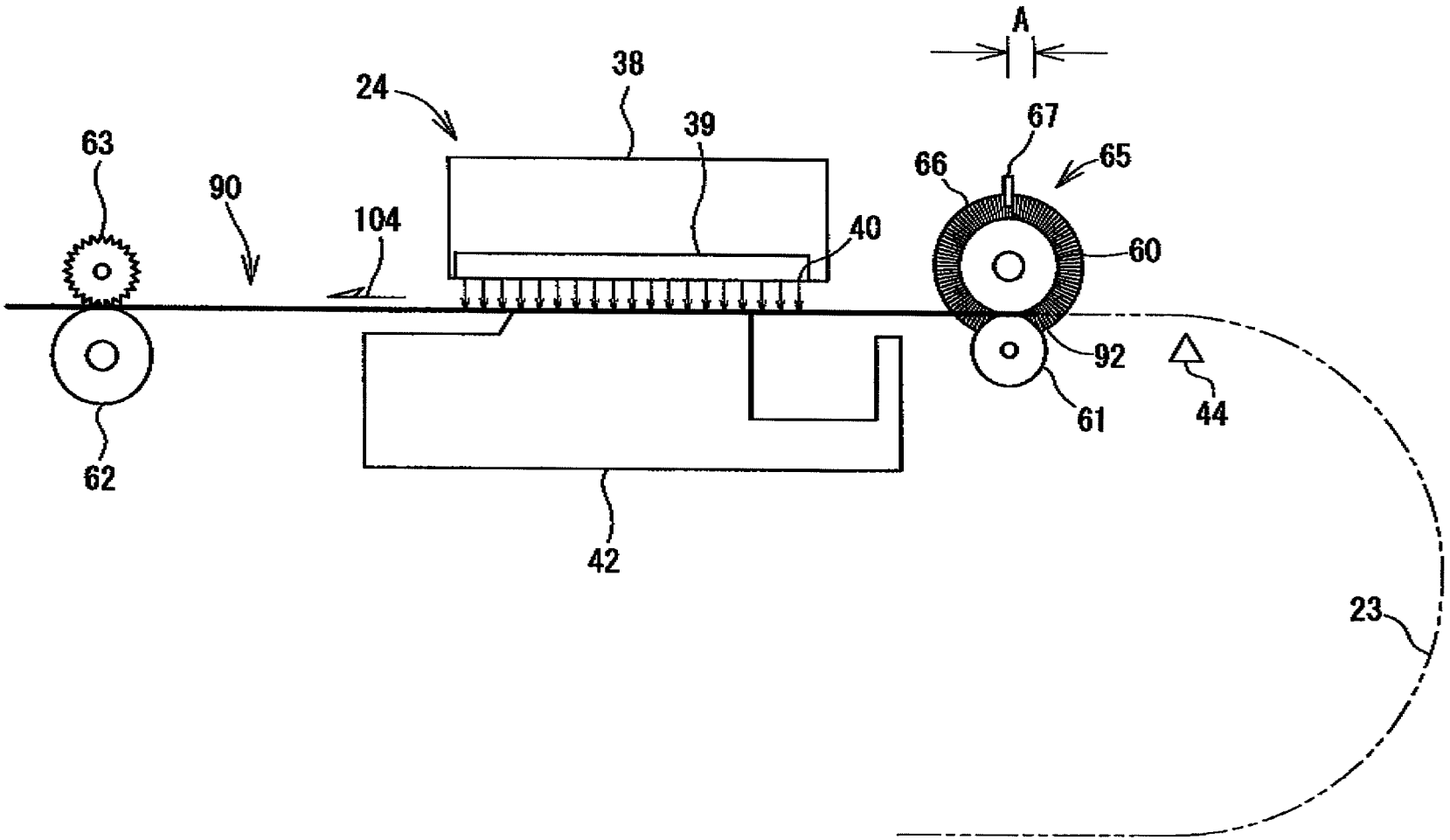
FIG. 8 is a schematic view of a state of the recording sheet after a (N−1)th intermittent feeding is performed in the printer portion.

In step S8, the control portion 70 corrects the head poke amount $H_1$ that is corrected based on the characteristic value P in such a manner as meeting the inequality (1). In particular, after subtracting the head poke amount H from the whole length L of the recording sheet 90, the control portion 70 further subtracts the target feed amount $F_{(K)}$ sequentially from K=1 to K=N−1, where N is a number of times of feeding which the recording sheet 90 is intermittently fed by the pair of rollers 60, 61 for a period until the trailing end 92 of the recording sheet 90 passes through the nip position of the pair of rollers 60, 61 since the first nip position 94 is nipped by the pair of rollers 60, 61 or a head poke is performed. In other words, after subtracting the head poke amount H from the whole length L, further subtracting the target feed amount $F_{(K)}$ sequentially from K=1 to K=N−1 gives a remainder A, and the number of times of feeding N is determined as a largest one such that the remainder A is not negative, as shown in FIG. 8.

Figure 9:
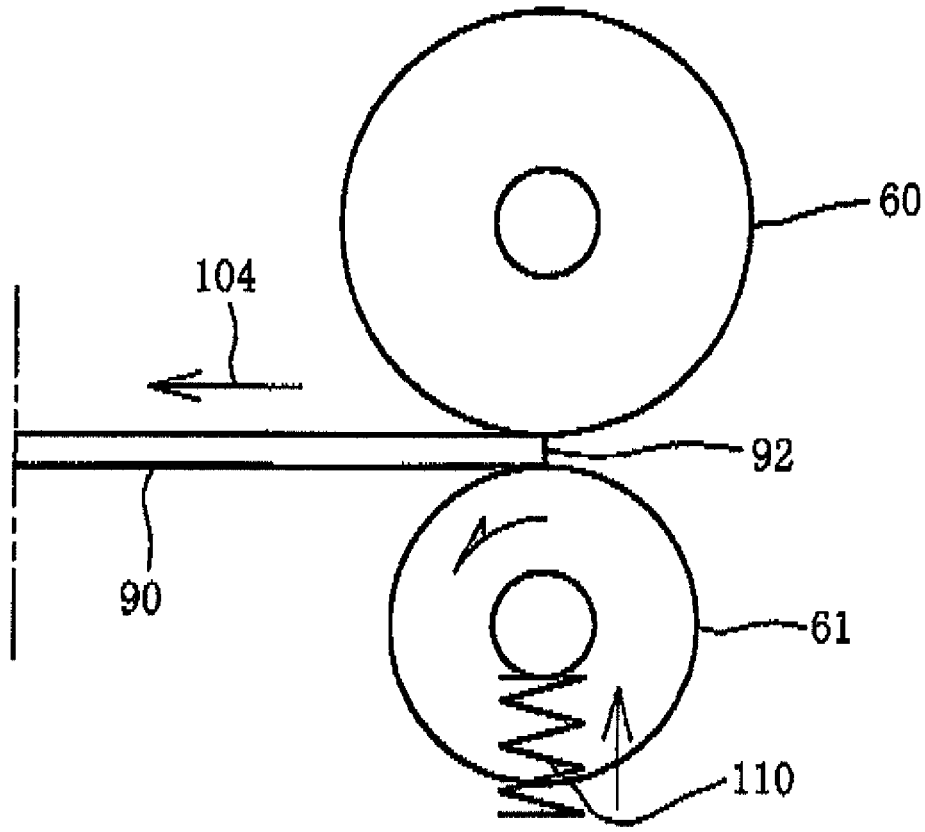
FIG. 9 is a schematic view showing a state in which a feed roller and a pinch roller of the printer portion nip a trailing end of the recording sheet.

As shown in FIG. 9, there is known that, when the trailing end 92 of the recording sheet 90 passes through the nip portion of the pair of rollers 60, 61, the recording sheet 90 is pushed out forward) or extruded in the feed direction 104. It is assumed that because a nipping pressure of the pair of rollers 60, 61 that are biased by the elastic member 110 is released at one time, the trailing end 92 is pushed out in the feed direction 104. When the recording sheet 90 is thus pushed out in the feed direction 104, the recording sheet 90 is fed by a feed amount that is larger than a target feed amount. Accordingly, a positional relation between the recording head 39 and the recording sheet 90 is misaligned, so that a banding occurs in the recorded image of the recording sheet 90. The banding occurs remarkably in a case where the pair of rollers 60, 61 are stopped in a state of nipping the trailing end 92 of the recording sheet 90.

Figure 10:
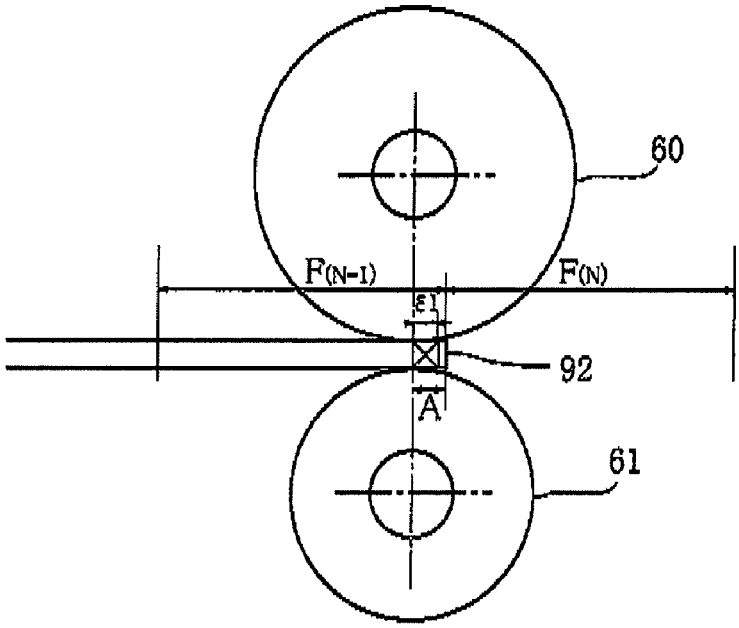
FIG. 10 is a view for explaining a setting of an upstream-side value.
Figure 11:
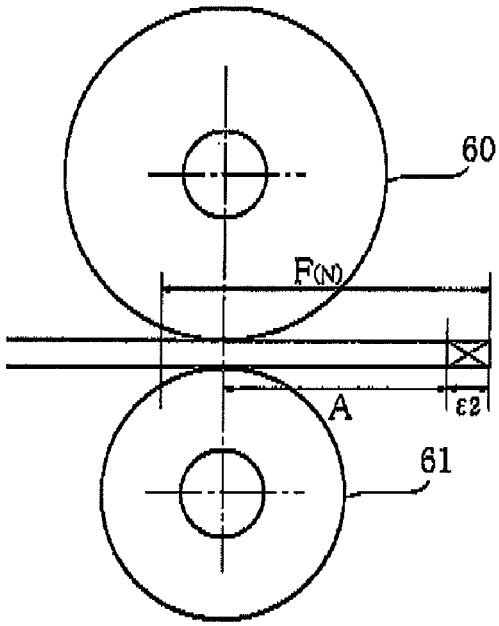
FIG. 11 is a view for explaining a setting of a downstream-side value.

In order to prevent the above-mentioned inconvenience from occurring, in the printer portion 11, the head poke amount $H_1$ is corrected such that the remainder A is equal to or larger than an upstream-side value $\epsilon_1$ shown in FIG. 10 and is equal to or smaller than a value that is given by subtracting a downstream-side value $\epsilon_2$ shown in FIG. 11 from the target feed amount $F_{(N)}$ of a Nth time. In the present embodiment, the upstream-side value $\epsilon_1$ and the downstream-side value $\epsilon_2$ are predetermined (set) values. Theoretically, there is no reason for that the upstream-side value $\epsilon_1$ is the same as the downstream-side value $\epsilon_2$, so that it can be considered that, even in a case where the upstream-side value $\epsilon_1$ is smaller than the downstream-side value $\epsilon_2$, the trailing end 92 of the recording sheet 90 is prevented from being pushed out in the feed direction 104. However, it is practically desirable that errors of the whole length L of the recording sheet 90 and errors of the feed amount by the pair of rollers 60, 61 are considered, and it is convenient that the upstream-side value $\epsilon_1$ and the downstream-side value $\epsilon_2$ are determined as the same value. For example, the upstream-side value $\epsilon_1$ and the downstream-side value $\epsilon_2$ are respectively determined as 0.5 mm, and the head poke amount $H_1$ is corrected in order to meet a condition as 0.5≦ remainder A≦target feed amount $F_{(N)}$−0.5. In this case, even in the intermittent feeding of a (N−1)th time, even in the intermittent feeding of the Nth time, the pair of rollers 60, 61 are not stopped in the state of nipping the trailing end 92 of the recording sheet 90. A head poke amount that is thus corrected is referred to as a head poke amount $H_2$. The head poke amount $H_2$ is stored as the print data in the RAM 73. In a case where the head poke amount $H_1$ meets the inequality (1), the correction of the head poke amount $H_1$ is unnecessary, however, in this specification, the head poke amount in a case where the correction thereof is not performed is also referred to as the head poke amount $H_2$. Further, although the head poke amount $H_2$ that meets the inequality (1) covers a wide range of amount, in a case where the remainder A is smaller than the upstream-side value $\epsilon_1$, the head poke amount $H_1$ is corrected in order that the remainder A is the upstream-side value $\epsilon_1$, and, in a case where the remainder A is larger than the value that is given by subtracting the downstream-side value $\epsilon_2$ from the target feed amount $F_{(N)}$ of the Nth time, the head poke amount $H_1$ is corrected in order that the remainder A is the above-mentioned value.

After the head poke amount H is corrected as mentioned above, the printing operation is performed (step S9 in FIG. 5). In particular, when the sheet-supply roller 25 is rotated by the LF motor 77, one of the recording sheets 90 accommodated by the sheet-supply tray 20 is fed to the sheet-feed path 23. The recording sheet 90 is fed through the sheet-feed path 23 in the feed direction 104, and the leading end 91 thereof reaches the resistor sensor 44. When the resistor sensor 44 detects the leading end 91 of the recording sheet 90, the output signal from the resistor sensor 44 is shifted from the OFF signal to the ON signal. When a predetermined time has passed (elapsed) since the output signal from the resistor sensor 44 is shifted, the leading end 91 of the recording sheet 90 reaches the nip position of the pair of rollers 60, 61. Therefore, the control portion 70 determines that the leading end 91 of the recording sheet 90 arrives at the nip portion, based on the shift of the output signal from the resistor sensor 44 and a passing time.

When the leading end 91 of the recording sheet 90 reaches the nip position, the feed roller 60 is not rotated. Accordingly, the recording sheet 90 is bent because the leading end 91 thereof is put into contact with a roller surface of the feed roller 60 or a roller surface of the pinch roller 61. Thus, an inclination of the recording sheet 90 in the sheet-feed path 23 is corrected. Then, the control portion 70 rotates the feed roller 60, so that the pair of rollers 60, 61 nip the leading end 91 of the recording sheet 90.

The control portion 70 obtains the rotation amount of the feed roller 60 since the rotation thereof is initiated, based on the pulse signals from the rotary encoder 65. The control portion 70 thus determines a position of the leading end 91 of the recording sheet 90. The control portion 70 rotates the feed roller 60 such that the recording sheet 90 is successively fed by the above-mentioned head poke amount $H_2$, and then, the feed roller 60 is stopped. Therefore, as shown in FIG. 7, the recording sheet 90 is stopped in a state in which the record-initiating position 93 of the recording sheet 90 is positioned right below or is opposed to the first nozzle 40 of the recording head 39.

As mentioned before, because the head poke amount $H_0$ is corrected so as to be the head poke amount $H_2$, the margin U slightly varies. When the recording sheet 90 is stopped, the control portion 70 drives the CR motor 79 such that the droplets of inks are selectively ejected from the recording head 39 based on the print data. The image recording on the recording sheet 90 is thus performed from the record-initiating position 93. Hereinafter, a unit in which the image recording is performed by ejecting the droplets of inks from the recording head 39 during one reciprocating movement of the carriage 38 is referred to as "one pass".

When a first pass of the image recording is finished, after stopping the rotation of the CR motor 79, the control portion 70 drives the LF motor 77 again to rotate the feed roller 60. At this time, the rotation amount of the feed roller 60 is the target feed amount $F_{(1)}$ of the first time. Whether the rotation amount of the feed roller 60 reaches the target feed amount $F_{(1)}$ or not is determined based on the pulse signals from the rotary encoder 65. The control portion 70 controls the pair of rollers 60, 61 to feed the recording sheet 90 by the target feed amount $F_{(1)}$, and then stops the feed roller 60. Accordingly, after the recording sheet 90 is fed by the target feed amount $F_{(1)}$ in the feed direction 104, the recording sheet 90 is stopped. At this time, the pair of rollers 60, 61 nip the recording sheet 90 at a second nip position 95 thereof.

When feeding of the recording sheet 90 is stopped, the control portion 70 drives the CR motor 79 and the ink droplets are selectively ejected from the recording head 39 based on the print data. A second pass of the image recording is thus performed. When the second pass of the image recording is finished, after stopping the CR motor 79, the control portion 70 drives the LF motor 77 again to rotate the feed roller 60, so that the recording sheet 90 is fed in the feed direction 104 by the target feed amount $F_{(2)}$ of the second time, and then the feed roller 60 is stopped. Similar to the description before, a third pass of the image recording is performed. Because the intermittent feeding by the target feed amount $F_{(K)}$ and one pass of the image recording is alternately performed, the image is recorded in order from the leading end 91 of the recording sheet 90 to the trailing end 92 thereof.

After the image recording of a (N−2)th pass, when the pair of rollers 60, 61 feed the recording sheet 90 by the target feed amount $F_{(N-1)}$ of the (N−1)th time and are stopped, the pair of rollers 60, 61 nip a (N−1)th nip position 96 of the recording sheet 90. In this state, a distance between the (N−1)th nip position 96 and the trailing end 92 is the remainder A. Since the remainder A is positioned within the above-mentioned range, the (N−1)th nip position 96 does not overlap the trailing end 92. Further, a Nth nip position 97 when the pair of rollers 60, 61 feed the recording sheet 90 by the target feed amount $F_{(N)}$ and are stopped does not overlap the trailing end 92. Therefore, because the pair of rollers 60, 61 are not stopped in a state of nipping the trailing end 92, the recording sheet 90 is prevented from being pushed out in the feed direction 104.

When the recording sheet 90 is fed by the target feed amount $F_{(N)}$ of the Nth time, and the trailing end 92 of the recording sheet 90 passes through the nip position where the pair of rollers 60, 61 nip the recording sheet 90, the recording sheet 90 is then nipped by the sheet-discharge roller 62 and the spur roller 63 and is fed in the feed direction 104. At this time, in a case where the portion of the trailing end 92 of the recording sheet 90 has an image to be recorded, similar to the above description, the intermittent feeding and the one pass of the image recording is alternately performed and the image recording is performed. The recording sheet 90 on which the image is recorded is nipped by the sheet-discharge roller 62 and the spur roller 63 so as to be discharged onto the sheet-discharge tray 21.

In the image recording in the printer portion 11 of the MFD 10, the head poke amount H is adjusted in order for the pair of rollers 60, 61 not to be stopped in the state of nipping the trailing end 92 when the feed roller 60 is stopped, so that the pair of rollers 60, 61 are prevented from being stopped in the state of nipping the trailing end 92. Accordingly, it is prevented that the recording sheet 90 is pushed out in the feed direction 104 in the image recording operation, and the image recording can be performed without an occurrence of the banding.

Hereinafter, there will be described A second embodiment of the recording system and the recording method to which the present invention is applied. The second embodiment is different from the first embodiment in that a device that corrects the head poke amount H in order to meet the inequality (1) is not the MFD 10 but the computer 120 as the external data-processor device that is connected to the MFD 10. Except this, the second embodiment has the same structure as the first embodiment, so that, hereinafter, only operations of the printer portion 11 and the computer 120 will be described by reference to FIG. 12, and other descriptions will be omitted.

Prior to an input of the command to initiate a printing operation to the printer driver, the size of the recording sheet 90, the resolution of the recorded image, and the margin U provided in the recording sheet 90 are inputted by the operator through the input screen 132 of the display 130 and the input device 128. The computer 120 operates to store the size of the recording sheet 90, the resolution of the recorded image and the margins provided in the recording sheet 90, respectively as the size data, the resolution data and the margin data in the RAM 124. In a description later, information including the size data, the resolution data and the margin data will be sometimes referred to as driver configuration information.

Figure 12:
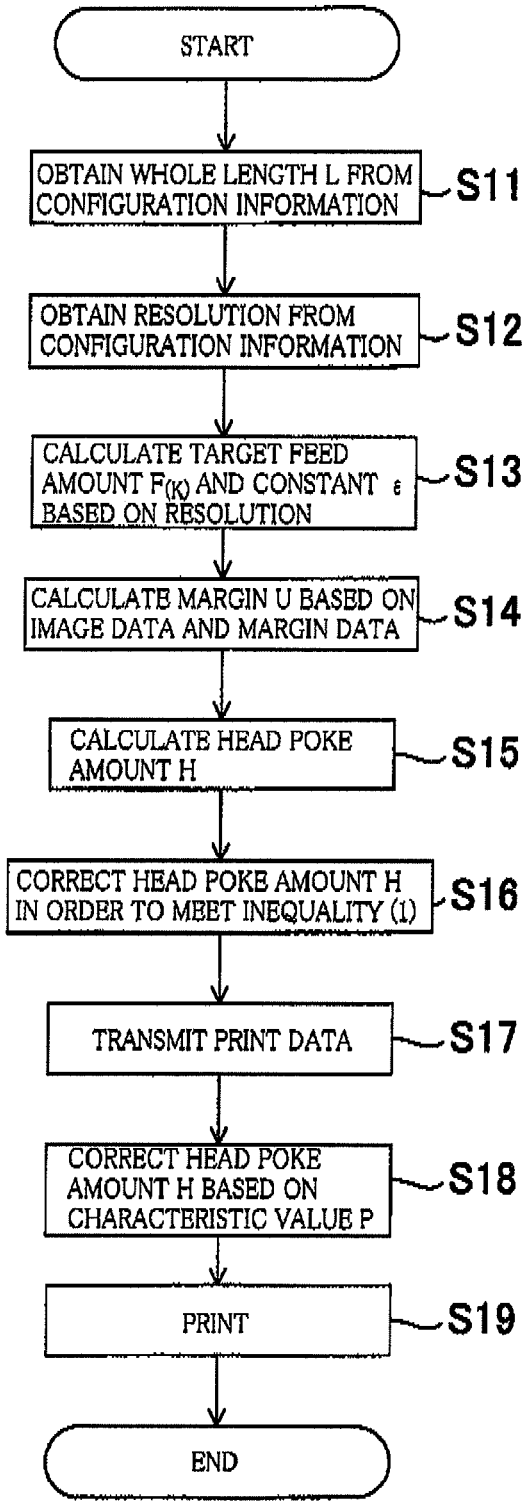
FIG. 12 is a flow chart illustrating a recording method in a second embodiment to which the present invention is applied.

When the command to initiate the printing operation is inputted to the printer driver, in step S11 in FIG. 12, the control portion 70 receives a whole length L of the recording sheet 90 from the driver configuration information. In the RAM 124 of the computer 120, the size data such as A4 size are stored, so that the whole length L is obtained based on the size data stored in the RAM 124.

Next, in step S12, the printer driver receives the resolution from the driver configuration information, and in step S13, a target feed amount $F_{(K)}$ and a constant $\epsilon$ are calculated based on the obtained resolution. The target feed amount $F_{(K)}$ is stored in the RAM 124 of the computer 120 in the form of a look-up table in which a plurality of target feed amounts $F_{(K)}$ are predetermined depending on a plurality of resolutions that can be inputted. The constant $\epsilon$ is also obtained corresponding to the target feed amount $F_{(K)}$. A plurality of constants $\epsilon$ are predetermined depending on the respective target feed amount $F_{(K)}$ and are stored in the form of a look-up table in the RAM 124 of the computer 120.

Next, in step S14, the printer driver calculates the margin U based on image data that are obtained from application soft installed in the computer 120 and the margin data that are stored in the RAM 124. Then, the head poke amount $H_0$ is calculated based on the margin U. As mentioned before, the head poke amount $H_0$ is a target amount for feeding the leading end 91 of the recording sheet 90 to the downstream side in the feed direction 104 from the nip position where the pair of rollers 60, 61 nip the recording sheet 90, when the image recording on the leading end portion of the recording sheet 90 is initiated, as shown in FIGS. 6 and 7. In the MFD 10, a distance of feeding between the nip position where the pair of rollers 60, 61 nip the recording sheet 90 and the first nozzle 40 of the recording head 39 is stored in the RAM 124 in the form of the look-up table corresponding to each of a plurality of MFDs 10.

In step S16, the printer driver corrects the head poke amount $H_0$ in such a manner as meeting the inequality (1). The method of correction is the same as that described in the first embodiment, so that a detailed description is omitted. The corrected head poke amount is referred to as the head poke amount $H_2$. The whole length L of the recording sheet 90, the target feed amount $F_{(K)}$ and the head poke amount $H_2$ that are obtained as mentioned above are transmitted as the print data along with image data from the printer driver to the control portion 70 of the MFD 10 (step S17).

The control portion 70 receives and stores in the RAM 73 the print data. Then, in step S18, the control portion 70 corrects the head poke amount $H_2$ that is included in the print data stored in the RAM 73 based on a characteristic value P of the MFD 10. The characteristic value P is previously stored in the ROM 72. The corrected head poke amount is referred to as the head poke amount $H_1$.

After the head poke amount H is corrected as mentioned above, the printing operation is performed (step S19 in FIG. 12). The printing operation is performed in the same manner as the first embodiment. As mentioned above, the head poke amount $H_0$ is corrected to be the head poke amount $H_1$, so that the (N−1)th nip position 96 does not overlap the trailing end 92 of the recording sheet 90. Further, the Nth nip position 97 when the pair of rollers 60, 61 feed the recording sheet 90 by the target feed amount $F_{(N)}$ and are stopped does not overlap the trailing end 92. Therefore, because the pair of rollers 60, 61 are not stopped in the state of nipping the trailing end 92, the recording sheet 90 is prevented from being pushed out in the feed direction 104.

Hereinafter, there will be described a third embodiment of the recording system and the recording method to which the present invention is applied. The third embodiment is different from the first and the second embodiments in that the head poke amount H is corrected in order to meet the equation (2). Except this, the third embodiment adopts the same structure and the method of correction as those in the first and the second embodiments, so that, hereinafter, only that the head poke amount H is corrected in order to meet the equation (2) will be described in detail, and other descriptions will be omitted.

$$H = L - \sum_{K=1}^{N-1} F_{(K)} - \frac{1}{2} F_{(N)} \quad \text{[Equation (2)]}$$

The control portion 70 controls the head poke amount H of the recording sheet 90 in such a manner as meeting the equation (2). In particular, in the control portion 70, subtracting the target feed amount $F_{(K)}$ sequentially from K=1 to K=N−1 from the whole length L of the recording sheet 90 gives the remainder A, and the head poke amount H is determined such that the remainder A is a half of the target feed amount $F_{(N)}$, where N is a number of times of feeding which the recording sheet 90 is intermittently fed by the pair of rollers 60, 61 for a period until the trailing end 92 of the recording sheet 90 passes through the nip position of the pair of rollers 60, 61 since the first nip position 94 is nipped by the pair of rollers 60, 61 or a head poke is performed. In other words, subtracting the target feed amount $F_{(K)}$ sequentially from K=1 to K=N−1 from the whole length L gives the remainder A, and the number of times of feeding N is determined as a largest number of times such that the remainder A is not negative.

Since the remainder A is a half of the target feed amount $F_{(N)}$, in the (N−1)th intermittent feeding, a middle point between the (N−1)th nip position 96 and the Nth nip position 97 of the recording sheet 90 is nipped by the pair of rollers 60, 61 and then, the feed roller 60 is stopped. Therefore, in the Nth intermittent feeding, the pair of rollers 60, 61 are prevented from being stopped in the state of nipping the trailing end 92 of the recording sheet 90.

What is claimed is:

1. A recording system, comprising:

a feeding device which includes a pair of rollers that cooperate with each other to nip a recording medium having a first end and a second end and which is configured to intermittently feed the recording medium in a feed direction in such a manner that the first end is a leading end and the second end is a trailing end;

a recording device which is provided on a downstream side of the feeding device in the feed direction and which is configured to record an image on the recording medium while feeding of the recording medium by the feeding device is stopped; and a control device which is configured to control operations of the feeding device, wherein the control device includes:

a resolution receiving portion which is configured to receive an input of resolution of a recorded image on the recording medium;

a resolution-data retaining portion which is configured to retain the resolution inputted to the resolution receiving portion as resolution data; and a target-feed-amount obtaining portion which is configured to obtain a target feed amount based on the resolution data retained by the resolution-data retaining portion, the obtained target feed amount being predetermined as a constant amount while the recording device records in the resolution, and an adjusting portion which is configured to adjust, based on the constant target feed amount obtained by the target-feed amount obtaining portion, an amount of head poke that is an amount of the recording medium between the leading end thereof and a first position where the recording medium is nipped by the pair of rollers when a first recording operation is performed by the recording device, such that when, assuming that an intermittent feeding of the recording medium and a recording operation thereon are repeated after the first recording operation, the recording medium is stopped, the trailing end is positioned outside of a predetermined range relative to a nip position of the pair of rollers.

2. The recording system according to claim 1, wherein the control device includes:

a size receiving portion which is configured to receive an input of a size of the fed recording medium;

a size-data retaining portion which is configured to retain the size of the recording medium that is inputted to the size receiving portion as size data; and a recording-medium-whole-length obtaining portion which is configured to obtain a whole length L of the recording medium based on the size data that are retained by the size-data retaining portion.

3. The recording system according to claim 1, wherein the control device includes:

a resolution receiving portion which is configured to receive an input of resolution of a recorded image on the recording medium;

a resolution-data retaining portion which is configured to retain the resolution that is inputted to the resolution receiving portion as resolution data; and a target-feed-amount obtaining portion which is configured to obtain a target feed amount $F_{(K)}$ based on the resolution data that are retained by the resolution-data retaining portion.

4. The recording system according to claim 1, wherein the control device includes:

a margin receiving portion which is configured to receive an input of a margin that is provided on a side of the leading end of the recording medium;

a margin-data retaining portion which is configured to retain the margin that is inputted to the margin receiving portion as margin data; and a head-poke-amount obtaining portion which is configured to obtain a head poke amount H based on the margin data that are retained by the margin-data retaining portion.

5. The recording system according to claim 1, wherein the pair of rollers of the feeding device includes:

a feed roller which is configured to be rotated by a drive force transmitted from a drive source; and a pinch roller which is provided to be movable toward and away from the feed roller and is biased to a side of the feed roller.

6. The recording system according to claim 1, wherein the recording device includes an inkjet head that is configured to perform a recording operation by ejecting ink droplets through at least one nozzle thereof.

7. A recording system, comprising:

a feeding device which includes a pair of rollers that cooperate with each other to nip a recording medium having a first end and a second end and which is configured to intermittently feed the recording medium in a feed direction in such a manner that the first end is a leading end and the second end is a trailing end;

a recording device which is provided on a downstream side of the feeding device in the feed direction and which is configured to record an image on the recording medium while feeding of the recording medium by the feeding device is stopped; and a control device which is configured to control operations of the feeding device, wherein the control device includes an adjusting portion which is configured to adjust an amount of head poke that is an amount of the recording medium between the leading end thereof and a first position where the recording medium is nipped by the pair of rollers when a first recording operation is performed by the recording device, in a case where it is predicted that, when, assuming that an intermittent feeding of the recording medium and a recording operation thereon are repeated after the first recording operation, the recording medium is stopped, the trailing end is positioned within a predetermined range relative to a nip position of the pair of rollers, the adjusting portion being configured to adjust the amount of head poke such that the trailing end is positioned outside the predetermined range, and wherein the adjusting portion includes a head-poke-amount correcting portion which is configured to correct the head poke amount H so as to meet a following inequality (1), by using of an upstream-side value $\epsilon_1$ and a downstream-side value $\epsilon_2$ that meet such conditions as $0<\epsilon_1<F_{(N)}$ and $0<\epsilon_2<F_{(N)}$, respectively, where a whole length L is a length of the recording medium in the feed direction, a target feed amount $F_{(K)}$ stands for a target feed amount of a Kth time by the feeding device to feed one recording medium, and a number of times of feeding N is a number of times which the recording medium is intermittently fed by the feeding device for a period until the trailing end passes through the nip position of the pair of rollers since the first position is nipped by the pair of rollers:

$$\varepsilon_1 \leqq L - H - \sum_{K=1}^{N-1} F_{(K)} \leqq F_{(N)} - \varepsilon_2. \quad \text{[Inequality (1)]}$$

8. The recording system according to claim 7, wherein the upstream-side value $\epsilon_1$ and the downstream-side value $\epsilon_2$ that respectively meet such conditions as $0<\epsilon_1<F_{(N)}$ and $0<\epsilon_2<F_{(N)}$ are respectively predetermined value.

9. The recording system according to claim 8, wherein the downstream-side value $\epsilon_2$ is larger than the upstream-side value $\epsilon_1$.

10. A recording system, comprising:

a feeding device which includes a pair of rollers that cooperate with each other to nip a recording medium having a first end and a second end and which is configured to intermittently feed the recording medium in a feed direction in such a manner that the first end is a leading end and the second end is a trailing end;

a recording device which is provided on a downstream side of the feeding device in the feed direction and which is configured to record an image on the recording medium while feeding of the recording medium by the feeding device is stopped; and a control device which is configured to control operations of the feeding device, wherein the control device includes an adjusting portion which is configured to adjust an amount of head poke that is an amount of the recording medium between the leading end thereof and a first position where the recording medium is nipped by the pair of rollers when a first recording operation is performed by the recording device, in a case where it is predicted that, when, assuming that an intermittent feeding of the recording medium and a recording operation thereon are repeated after the first recording operation, the recording medium is stopped, the trailing end is positioned within a predetermined range relative to a nip position of the pair of rollers, the adjusting portion being configured to adjust the amount of head poke such that the trailing end is positioned outside the predetermined range, and wherein the adjusting portion includes a head-poke-amount determining portion which is configured to determine the head poke amount H so as to meet the following equation (2), where a whole length L is a length of the recording medium in the feed direction, a target feed amount $F_{(K)}$ stands for a target feed amount of a Kth time by the feeding device to feed one recording medium, and a number of times of feeding N is a number of times which the recording medium is intermittently fed by the feeding device for a period until the trailing end passes through the nip position of the pair of rollers since the first position is nipped by the pair of rollers:

$$H = L - \sum_{K=1}^{N-1} F_{(K)} - \frac{1}{2} F_{(N)}. \quad \text{[Equation (2)]}$$

11. A recording method in which a recording medium having a first end and a second end is nipped by a pair of rollers of a feeding device and is intermittently fed in a feed direction in such a manner that the first end is a leading end and the second end is a trailing end, and in which an image is recorded on the recording medium by a recording device that is provided on a downstream side of the feeding device in the feed direction while feeding of the recording medium by the feeding device is stopped, and a target feed amount determined based on resolution data of a recorded image is obtained, the obtained target feed amount being predetermined as a constant amount while the recording device records in the resolution, wherein an amount of head poke that is an amount of the recording medium between the leading end thereof and a first position where the recording medium is nipped by the pair of rollers when a first recording operation is performed by the recording device is adjusted based on the constant target feed amount, such that, when, assuming that an intermittent feeding of the recording medium and a recording operation thereon are repeated after the first recording operation, the recording medium is stopped, a position of the trailing end of the recording medium is positioned outside of a predetermined range relative to a nip position of the pair of rollers.

12. A recording method in which a recording medium having a first end and a second end is nipped by a pair of rollers of a feeding device and is intermittently fed in a feed direction in such a manner that the first end is a leading end and the second end is a trailing end, and in which an image is recorded on the recording medium by a recording device that is provided on a downstream side of the feeding device in the feed direction while feeding of the recording medium by the feeding device is stopped, wherein an amount of head poke that is an amount of the recording medium between the leading end thereof and a first position where the recording medium is nipped by the pair of rollers when a first recording operation is performed by the recording device is adjusted, in a case where it is predicted that, when, assuming that an intermittent feeding of the recording medium and a recording operation thereon are repeated after the first recording operation, the recording medium is stopped, a position of the trailing end of the recording medium is positioned within a predetermined range relative to a nip position of the pair of rollers, the amount of head poke being adjusted such that the trailing end is positioned outside the predetermined range, and wherein adjusting of the head poke amount includes correcting of the head poke amount H so as to satisfy the following inequality (1), by using of an upstream-side value $\epsilon_1$ and a downstream-side value $\epsilon_2$ that meet such conditions as $0<\epsilon_1<F_{(N)}$ and $0<\epsilon_2<F_{(N)}$, respectively, where a whole length L is a length of the recording medium in the feed direction, a target feed amount $F_{(K)}$ stands for a target feed amount of a Kth time by the feeding device to feed one recording medium, and a number of times of feeding N is a number of times which the recording medium is intermittently fed by the feeding device for a period until the trailing end passes through the nip position of the pair of rollers since the first position is nipped by the pair of rollers:

$$\varepsilon_1 \leqq L - H - \sum_{K=1}^{N-1} F_{(K)} \leqq F_{(N)} - \varepsilon_2. \quad \text{[Inequality (1)]}$$

13. A recording method in which a recording medium having a first end and a second end is nipped by a pair of rollers of a feeding device and is intermittently fed in a feed direction in such a manner that the first end is a leading end and the second end is a trailing end, and in which an image is recorded on the recording medium by a recording device that is provided on a downstream side of the feeding device in the feed direction while feeding of the recording medium by the feeding device is stopped, wherein an amount of head poke that is an amount of the recording medium between the leading end thereof and a first position where the recording medium is nipped by the pair of rollers when a first recording operation is performed by the recording device is adjusted, in a case where it is predicted that, when, assuming that an intermittent feeding of the recording medium and a recording operation thereon are repeated after the first recording operation, the recording medium is stopped, a position of the trailing end of the recording medium is positioned within a predetermined range relative to a nip position of the pair of rollers, the amount of head poke being adjusted such that the trailing end is positioned outside the predetermined range, and wherein adjusting of the head poke amount includes determining of the head poke amount H so as to meet the following equation (2), where a whole length L is a length of the recording medium in the feed direction, a target feed amount F(K) stands for a target feed amount of the Kth time by the feeding device to feed one recording medium, and a number of times of feeding N is a number of times which the recording medium is intermittently fed by the feeding device for a period until the trailing end passes through the nip position of the pair of rollers since the first position is nipped by the pair of rollers:

$$H = L - \sum_{K=1}^{N-1} F_{(K)} - \frac{1}{2} F_{(N)}. \quad \text{[Equation (2)]}$$

* * * * *